US006386359B2

(12) United States Patent
Ahlberg

(10) Patent No.: US 6,386,359 B2
(45) Date of Patent: May 14, 2002

(54) STORAGE UNIT

(76) Inventor: Erik Ola Ahlberg, S:t Eriksgaten 109. 113 31, Stockholm (SE)

( * ) Notice: Subject to any disclaimer, the term of this patent is extended or adjusted under 35 U.S.C. 154(b) by 0 days.

(21) Appl. No.: 09/745,487

(22) Filed: Dec. 26, 2000

Related U.S. Application Data

(63) Continuation of application No. 09/180,949, filed as application No. PCT/SE97/00829 on May 21, 1997.

(30) Foreign Application Priority Data

May 22, 1996 (SE) ..... 96 01937

(51) Int. Cl.[7] ..... B65D 71/00

(52) U.S. Cl. ..... 206/225; 206/408; 220/501; 190/18 A

(58) Field of Search ..... 206/225, 408; 220/501, 521, 523; 190/18 A

(56) References Cited

U.S. PATENT DOCUMENTS 2,611,476 A * 9/1952 Coney ..... 206/541
2,766,796 A * 10/1956 Tupper ..... 220/521
4,905,853 A * 3/1990 Strawder ..... 220/523
4,993,584 A * 2/1991 Macario ..... 220/523

FOREIGN PATENT DOCUMENTS

CA 2167331 * 7/1997

* cited by examiner

*Primary Examiner*—Mickey Yu
*Assistant Examiner*—Troy Arnold
(74) *Attorney, Agent, or Firm*—Spencer Fane Britt & Browne LLP

(57) ABSTRACT

The invention comprises an openable and closable storage unit (1) adapted so as to be capable of enclosing a folded-up display unit (2), consisting of one or more stand parts and one or more information-carrying sheets, screens or the like, first and second end-wall parts (11, 12) which belong to a wall part (10), said wall part (10) being arranged to, in cross section, form a cross-sectional area following one or both said end-wall parts (11, 12). A first storage space (5) is given a circular or in any case essentially circular cross section by means of part-circular units (7) which are formed in plane wall sections (10*b*) or applied thereto. A second storage space (6) is given a semi-circular or in any case essentially semi-circular cross section by means of units (8) which are formed in or next to said plane wall sections or attached thereto.

4 Claims, 1 Drawing Sheet

STORAGE UNIT

This application is a continuation of Ser. No. 09/180,949, Nov. 18, 1998 which is a 371 of PCT/SE97/00829, May 21, 1997.

TECHNICAL FIELD

The present invention relates generally to a storage unit and more specifically to those storage units which, via a lid or the like, can be closed or opened by application of the lid or removal of the lid from a storage box.

The present invention relates more specifically to those openable and closable storage units which are adapted so as to be capable of enclosing, within an inner space, a folded-up complete display unit, consisting of one or more fold-out and collapsible stand parts and one or more roll-up information-carrying sheets, screens or the like, where the latter are easily attached to the former.

A storage unit of this kind has a wall part which encloses the unit or forms a box and first and second end-wall parts, an upper lid related and a lower end-wall part, which interact and/or are integrated with this wall part, said wall part being arranged to, in cross-section, form a cross-sectional area following or in any case essentially following one or both said end-wall parts, in which said wall part can be considered to consist of two opposite semi-cylindrical wall sections interconnected by two plane interposed wall sections, in addition to which, within said wall part and delimited by in any case one end-wall part, there are in any case two different storage spaces.

In these units, one storage space is intended for rolled-up information-carrying sheets or equivalent and the second space is intended for folded-up stand parts.

The height of the storage units is thus designed to exceed slightly the height of said sheets or alternatively of said stand parts.

PRIOR ART

Storage units for collapsible and fold-out complete display units, consisting of one or more stand parts and one or more information-carrying sheets or screens, are previously known in a large number of embodiments.

As an example, it may be mentioned that it is previously known to make use of a moulded storage unit made of polyethylene with wheels, which has been dimensioned with an inner space adapted so to be capable of enclosing a selected complete display unit.

It is also previously known to reinforce storage units of this type with edge and corner reinforcements, usually incorporated in the plastic material.

It is also previously known to make use of transport carts in order, by means of these, to transport folded-up display units from one exhibition location to another.

If the features associated with the present invention are now considered, it can be said that the storage unit is to be designed with dimensions adapted so as to be capable of storing such a folded-up display unit as is offered for sale under the trademark NETWORK (registered trademark) by Maxibit AB, Stockholm, Sweden.

DESCRIPTION OF THE PRESENT INVENTION

Technical Problem

Considering the prior art with regard to openable and closable storage units of the kind indicated in the introduction, it certainly ought to be deemed a technical problem to be able to indicate a construction for a storage unit so that it can in a simple manner enclose and be stable enough for transport of a folded-up complete display unit, and which has moreover been given an outer design which is adapted so as to be capable of serving as a podium or as a rostrum.

There is also a technical problem in being able to indicate a storage unit for a folded-up display unit which, in a closed state with interacting end-wall parts, can offer such a bending-resistant construction, in spite of thin wall parts, that said storage unit can serve as a transport box or a display case, a podium or the like and as such can be placed in front of or next to a folded-out display unit.

It must also be deemed a technical problem to be able to indicate a storage unit of this type which affords a flexible, light and strong transport packaging.

There is also a technical problem in being able to indicate an openable and closable storage unit which, during the exhibition itself, can be used as an integrated part of a folded-out complete display unit.

It must also be deemed a technical problem to be able to offer such a construction for the storage unit, taking the above-mentioned requirements into consideration, as can be given an appropriate podium height, approximately 1 meter, and which, in spite of low weight and light construction, has sufficiently great stability for it to be possible to place a TV monitor, a computer or another heavy product on an upper bearing surface.

There is also a technical problem in being able to indicate a storage unit which is particularly appropriate for transport, with an outer design and decor which matches other presentation materials and which can serve as a podium, usually with the use of well formed and simple concealment which can cover any transport damage on the storage unit.

There is also a technical problem, in a storage unit of the kind indicated in the introduction and for the technical field indicated above, of understanding the significance of, within said wall part and delimited by in any case one end-wall part, forming in any case two intercommunicating storage spaces.

There is also a technical problem in being able to have one storage space given a circular or in any case essentially circular cross-section by means of part-circular inwardly directed projections which are formed in said plane wall sections or applied thereto.

There is also a technical problem in being able to understand the advantages associated with having the second storage space given a semi-circular or in any case essentially semi-circular cross-section by means of inwardly directed projections which are formed in or next to said plane wall sections or attached thereto.

From the manufacturing point of view, it certainly also ought to be deemed a technical problem to be able to understand the significance of having said part-circular units and said units or projections constituted by integrated parts and it is indicated in particular that a part-circular unit and an adjacent unit are formed adjacent one another and can cover a recess in one of said wall sections.

There is also a technical problem in being able to understand the stabilizing effect which a number of part-circular units with adjacent units affords when these are arranged one above another within a plane wall section and in particular if two parallel plane wall sections are provided with opposite units.

There is also a technical problem in being able to understand the significance and the possibilities of having an upper end-wall part formed with an upwardly facing peripheral edge to form an upper shallow hollow in the end-wall part.

There is also a technical problem in being able to understand the significance of having the upper end-wall part have a delimited space arranged under the hollow.

There is also a technical problem in being able to understand the significance of having the circular cross-section selected with a radius of curvature which is appropriate for one or more rolled-up picture lengths, and of these rolled-up picture lengths forming a further centrally located, delimited storage space.

From the manufacturing point of view, it certainly also ought to be deemed a technical problem to be able to understand the significance of having opposite units dimensioned in order to form an opening between said two storage spaces and of said units being arranged at an appropriate distance from one another.

Solution

In order to be able to solve one or more of the technical problems indicated above, the present invention is based on an openable and closable storage unit adapted so as to be capable of enclosing a folded-up complete display unit, consisting of one or more stand parts and one or more information-carrying sheets, screens or the like, which storage unit is to be capable of serving as a podium or the like, with a wall part which encloses the unit and first and second end-wall parts which interact and/or are integrated with this wall part, said wall part being arranged to, in cross-section, form a cross-sectional area following or in any case essentially following one or both said end-wall parts, in which said wall part can be considered to consist of two opposite semi-cylindrical wall sections interconnected by two plane interposed wall sections, in addition to which, within said wall part and delimited by in any case one end-wall part, there are in any case two storage spaces.

In such a storage unit, the present invention indicates, in order to solve one or more of the technical problems indicated above, that one storage space is given a circular or in any case essentially circular cross-section by means of part-circular units which are formed in said plane wall sections or applied thereto, and that the second storage space is given a semi-circular or in any case essentially semi-circular cross-section by means of units which are formed in or next to said plane wall sections or attached thereto.

By way of proposed embodiments, which fall within the scope of the inventive idea, it is indicated that one of said part-circular units and an adjacent unit are constituted by an integrated part.

It is further indicated that one of said part-circular units and an adjacent unit are formed via a recess in one of said wall sections.

Furthermore, it is indicated that a number of part-circular units with adjacent units are arranged one above another within a plane wall section.

The invention indicates in particular that two parallel plane wall sections are provided with opposite units.

Furthermore, it is indicated that an upper end-wall part is formed with an upwardly facing peripheral edge for forming a hollow and that there is a delimited space within the upper end-wall part.

It is further indicated that the circular cross-section is selected with a radius of curvature which is appropriate for one or more rolled-up picture lengths and that these, rolled up, form a further delimited, centrally located storage space.

Furthermore, it is indicated that opposite units are to be dimensioned so as to form an opening between said two storage spaces.

It is further indicated that said units are arranged at a distance from one another.

Advantages

The advantages which can chiefly be deemed to be characteristic of a storage unit according to the present invention are that, by these means, the prerequisites have been created not only for, in an easy manner, being able to obtain a storage unit or storage box which is particularly appropriate for transport of folded-up display units, but also for this storage unit being capable of being used as a podium or the like and with an outer design and cover which can follow the design of a folded-out display unit.

The features which can chiefly be deemed to be characteristic of an openable and closable storage unit according to the present invention are indicated in the characterizing part of patent claim 1 below.

BRIEF DESCRIPTION OF THE FIGURES

A storage unit, which is proposed for the time being and has the characteristics which are significant of the present invention, and its application will now be described in greater detail with reference to the attached drawing, in which.

DESCRIPTION OF THE PROPOSED EMBODIMENT

Figure 1:
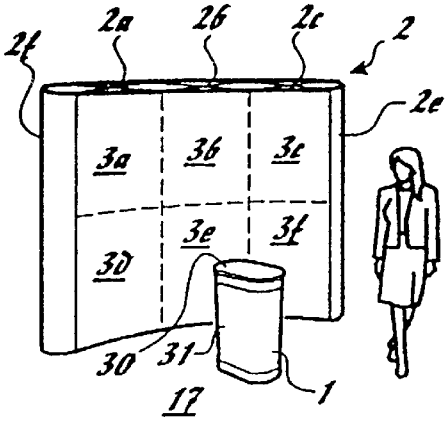
FIG. 1 shows a perspective view of a folded-out display unit with a storage unit indicated according to the invention, completed by a cover so as to be capable of serving as a podium.

With reference to FIG. 1, this accordingly shows an empty storage unit 1 in a perspective view, which is adapted so as to be capable of enclosing and receiving a folded-up complete display unit 2.

The display unit 2 consists of one or more stand parts, illustrated in FIG. 1 as three stand sections 2*a,* 2*b* and 2*c* and one or more information-carrying sheets attached to the stand sections, illustrated in the exemplary embodiment as three information-carrying sheets divided into two 3*a,* 3*d;* 3*b,* 3*e* and 3*c,* 3*f.*

The display unit 2 also has rounded edge parts 2*e,* 2*f* in this case.

As this display unit 2 is previously known, it is not described in any greater detail here although it should be mentioned that the sections of the stand unit 2 can adopt a folded-out position shown in FIG. 1 or a folded-up position intended for packing.

The information-carrying sheets 3*a,* 3*d;* 3*b,* 3*e* and 3*c,* 3*f* can be attached in a known manner to a folded-out stand unit 2 and consist of a suitable material so that the sheets can be rolled up.

The same applies for the edge parts 2*e,* 2*f.*

The storage unit 1 can, as FIG. 1 shows, serve as a podium or the like when it is not being used as a storage unit or transport box.

Figure 2:
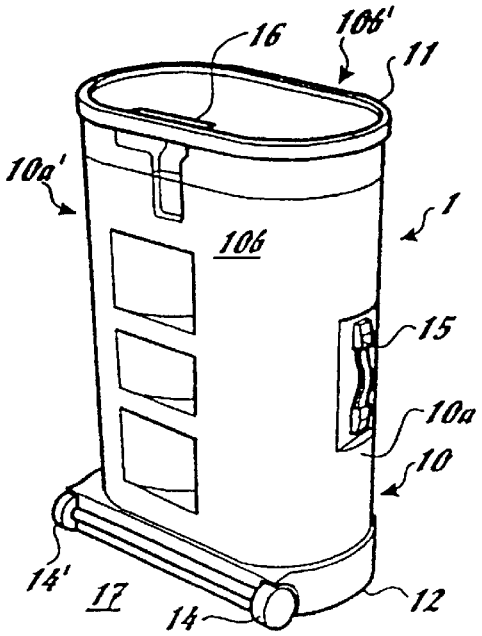
FIG. 2 shows a perspective view of the storage unit in a first perspective view, without cover.
Figure 3:
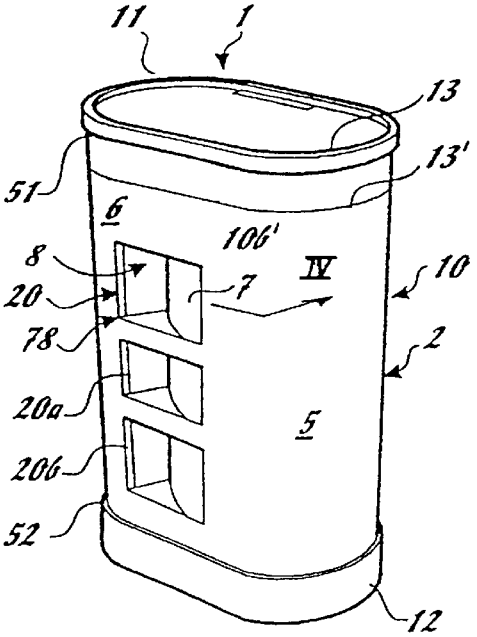
FIG. 3 shows the storage unit according to FIG. 2 in a second perspective view.
Figure 4:
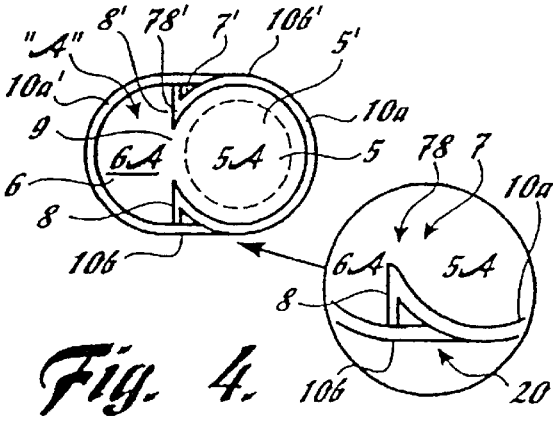
FIG. 4 shows the storage unit according to FIGS. 2 and 3 in section and in a partial enlargement.
Figure 5:
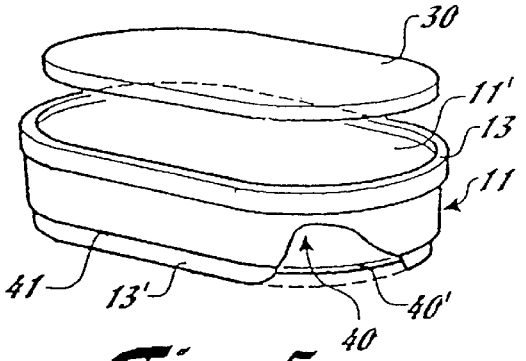
FIG. 5 shows a perspective view of an upper end-wall part with a plate above an upper plane surface.

With reference to FIGS. 2 and 3, the storage unit 1 is shown in a completely closed position in two different perspective views.

This storage unit 1 can be considered to consist of a wall part 10 which encloses the unit and first (upper) 11 and second (lower) 12 end-wall parts which interact and/or are integrated with this wall part, said wall part 10 being arranged to, in cross-section, form a cross-sectional area "A" following or in any case essentially following one or both said end-wall parts 11, 12.

Said wall part 10 can be seen as consisting of two opposite semi-cylindrical wall sections 10*a*, 10*a*' interconnected by two plane wall sections 10*b*, 10*b*'.

Within said wall part 10 and delimited by in any case one end-wall part, say the second or lower end-wall part 12, there are in any case two distinct storage spaces 5 and 6 arranged within said cross-sectional area "A".

One storage space 5 is given a circular or in any case essentially circular cross-section 5A by means of part-circular units 7, 7' formed in said plane wall sections 10*b*, 10*b*' or applied thereto, or inwardly directed projections.

The second storage space 6 is given a semi-circular or in any case essentially semi-circular cross-section 6A by means of units 8, 8' formed in or next to said plane wall sections 10*b*, 10*b*' or attached thereto, or inwardly directed projections.

One of said part-circular units 7, 7' and an adjacent unit 8, 8' can be constituted by an integrated part 78 and one of said part-circular units and an adjacent unit are formed as a projection at a recess 20 in one of said wall sections 10*b*'.

Each of the units 7, 8 can be applied and attached as a part to the inner surface of the wall part 10*b*' or integrated with the storage unit during manufacture.

The embodiment according to the present invention indicates that three units are located vertically one above another in the wall part 10*b*', and three corresponding units are located one above another in the wall part 10*b*, and for each unit 78 there is a recess 20, 20*a* and 20*b* in the wall part 10*b*'.

The recess 20 is arranged so as to extend across said plane wall part 10*b*'.

The recesses 20, 20*a* and 20*b* have a height which together occupies 30–70% of the total height of the storage unit, which may be 80–110 cm, preferably around 100 cm.

The exemplary embodiment illustrates that the recesses 20 and 20*b* have a greater height than the recess 20*a*, the height of the recess 20 exceeding the height of the recess 20*a* by 10–50%, preferably 30%.

The distance between adjacent recesses can be 20–40% of the height of the recess 20, preferably 30%.

The scope of the invention also includes of course the use of more or fewer units with or without a recess 20 and, as FIGS. 2 and 3 show, with greater or smaller vertical extent and, since the units are identical or essentially identical, the following description will include only the unit which is located in the recess 20.

The horizontal extent of the recess 20 could be slightly smaller than shown.

Generally, it can be said that it is appropriate that a number of part-circular units 7 with adjacent units 8 are arranged one above another entirely within a plane wall section 10*b*' and that the two parallel plane wall sections 10*b*, 10*b*' are provided with the same number of opposite units of the same shape.

The upper or first end-wall part 11 is formed with an upwardly facing peripheral edge 13 for forming a hollow 11', and at the same time it is shown that the upper end-wall part 11 can have a delimited space 40.

The end-wall part 11 constitutes a lid with a lower edge 13' adapted to interact with the upper part of the wall part 10.

The hollow 11' is dimensioned so as to have shallow depth and is adapted to be capable of receiving a plane block 30.

The inner space 40 is delimited by a lid 40' which advantageously can be attached to the plane side parts of the end-wall part via a hinge (not shown) 41.

The circular cross-section 5A of the space 5 is selected with a radius of curvature which is appropriate for one or more rolled-up picture lengths 3*a* . . . 3*f* and these form a further inner centrally delimited storage space 5' which is appropriate for rolled-up end parts 2*e*, 2*f*.

Opposite units 78, 78' are dimensioned so as to form an opening between said two storage spaces 5 and 6, with the opening given the reference number 9.

Said units 78, 78' can be dimensioned so that opposite edges are arranged at a distance from one another, say 10 to 20 cm, preferably about 15 cm.

The lower of said end-wall parts 12 is provided with wheels 14, 14'.

In any case, one of the semi-circular wall sections, say section 10*a*, is to be provided with a carrying handle 15.

A handle 16 next to the edge 13 is intended to form a hand-grip and with this the storage unit 1 can be rolled via the wheels 14, 14' along a surface 17.

The semi-circular space 6 is adapted so as to be capable of storing magnetic strips, shelf planes and shelf constructions, in addition to folded-up stands.

There is also a space 40 for spotlights in the lid 11.

The circular space 5 can accommodate a lacquered aluminium lid 30 and as a lining a decor panel 31 with magnetic tape at both short ends. This decor panel 31 is adapted so as to be capable of surrounding the transport unit 1 and covering the wall sections 10*a*, 10*b*, 10*a*', 10*b*' between the edges 51 and 52 by magnetic-strip interaction along the short ends. The lacquered plate lid 30 is located in the hollow 11 inside the border or the peripheral edge 13.

The invention is of course not restricted to the embodiment indicated above as an example but can be subjected to modifications within the scope of the inventive idea illustrated in the patent claims below.

What is claimed is:

1. A storage container comprising:

a generally continuous sidewall having a generally elliptical cross-section, said sidewall comprising an upper edge, a lower edge, an exterior surface and an interior surface, said interior surface defining a storage area, a plurality of opposed pairs of generally V-shaped flanges, each of said flanges having a first curved side and a second straight side, said flange pairs being connected to said sidewall interior surface with each of said flanges curved side being oriented to define a first generally circular storage portion and said flanges straight sides being oriented to define a second generally semi-circular storage portion, an insert unit for connection to said upper edge of said sidewall to seal said storage area at said upper edge, and a bottom panel for attachment to said sidewall lower edge to close said storage area at said lower edge.

2. The storage container as claimed in claim 1 wherein said insert unit further comprises a storage unit comprising:

a generally continuous side panel having a generally elliptical cross-section, said side panel comprising an upper edge, a lower edge, a floor attached to said lower edge, an exterior surface and an interior surface, said interior surface defining a storage void, and at least a portion of said exterior surface being of a dimension to fit within said storage device storage area, and a lid for connection with said sidewall upper edge, said lid being removable.

3. The storage container as claimed in claim 1 further comprising a handle on said continuous sidewall.

4. The storage container as claimed in claim 1 further comprising wheels attached to said bottom panel to permit wheeled movement of said storage device.

* * * * *